US012065220B2

(12) United States Patent
Eckl

(10) Patent No.: US 12,065,220 B2
(45) Date of Patent: Aug. 20, 2024

(54) CONNECTING DEVICE

(71) Applicant: Richmondo UG, Inning am Ammersee (DE)

(72) Inventor: Richard Eckl, Inning am Ammersee (DE)

(73) Assignee: RICHMONDO UG, Inning am Ammersee (DE)

( * ) Notice: Subject to any disclaimer, the term of this patent is extended or adjusted under 35 U.S.C. 154(b) by 309 days.

(21) Appl. No.: 17/526,505

(22) Filed: Nov. 15, 2021

(65) Prior Publication Data

US 2022/0153390 A1 May 19, 2022

(30) Foreign Application Priority Data

Nov. 17, 2020 (DE) ..... 102020214441.9

(51) Int. Cl.

| | |
|---|---|
| ***B63B 34/45*** | (2020.01) |
| ***B63B 34/21*** | (2020.01) |
| ***B63B 34/56*** | (2020.01) |
| ***B63B 34/565*** | (2020.01) |

(52) U.S. Cl.

CPC ..... *B63B 34/45* (2020.02); *B63B 34/56* (2020.02); *B63B 34/565* (2020.02); *B63B 34/21* (2020.02)

(58) Field of Classification Search

CPC ..... B63B 32/00; B63B 32/20; B63B 32/70; B63B 32/77; B63B 34/00; B63B 34/21; B63B 34/26; B63B 34/45; B63B 34/56; B63B 34/565; B63B 35/38; B63B 35/58; Y10T 403/59

USPC ..... 114/283, 343, 364, 39.12, 39.26, 39.28, 114/61.1, 61.14, 61.15, 61.18

See application file for complete search history.

(56) References Cited

U.S. PATENT DOCUMENTS

| | | | | |
|---|---|---|---|---|
| 5,501,169 A | | 3/1996 | Denker | |
| 5,868,091 A | | 2/1999 | Gross et al. | |
| 6,050,210 A | * | 4/2000 | Grzybowski | B63B 43/14 114/123 |
| 6,305,306 B1 | * | 10/2001 | Grzybowski | B63B 43/14 114/283 |

(Continued)

FOREIGN PATENT DOCUMENTS

| | | |
|---|---|---|
| DE | 3130907 A1 | 3/1983 |
| DE | 29912997 U1 | 8/2000 |

(Continued)

OTHER PUBLICATIONS

Search Report in corresponding EP21208418 dated Apr. 14, 2022 (ages 1-2).

*Primary Examiner* — Daniel V Venne

(74) *Attorney, Agent, or Firm* — Millen, White, Zelano & Branigan P.C.; William F. Nixon

(57) ABSTRACT

The present invention provides a connecting device for connecting at least two floating bodies, in particular at least two stand-up paddle boards, side by side, comprising: a linkage having at least one rod; and a plurality of fastening means arranged on the at least one rod of the linkage, at least some of the plurality of fastening means being provided axially displaceable along the axis of the at least one rod of the linkage adapted to the respective geometry of the at least two floating bodies such that each floating body can be clamped between at least two fastening means on the at least one rod of the linkage in a positionally stable manner.

16 Claims, 13 Drawing Sheets

(56) References Cited

U.S. PATENT DOCUMENTS

Figure 1:
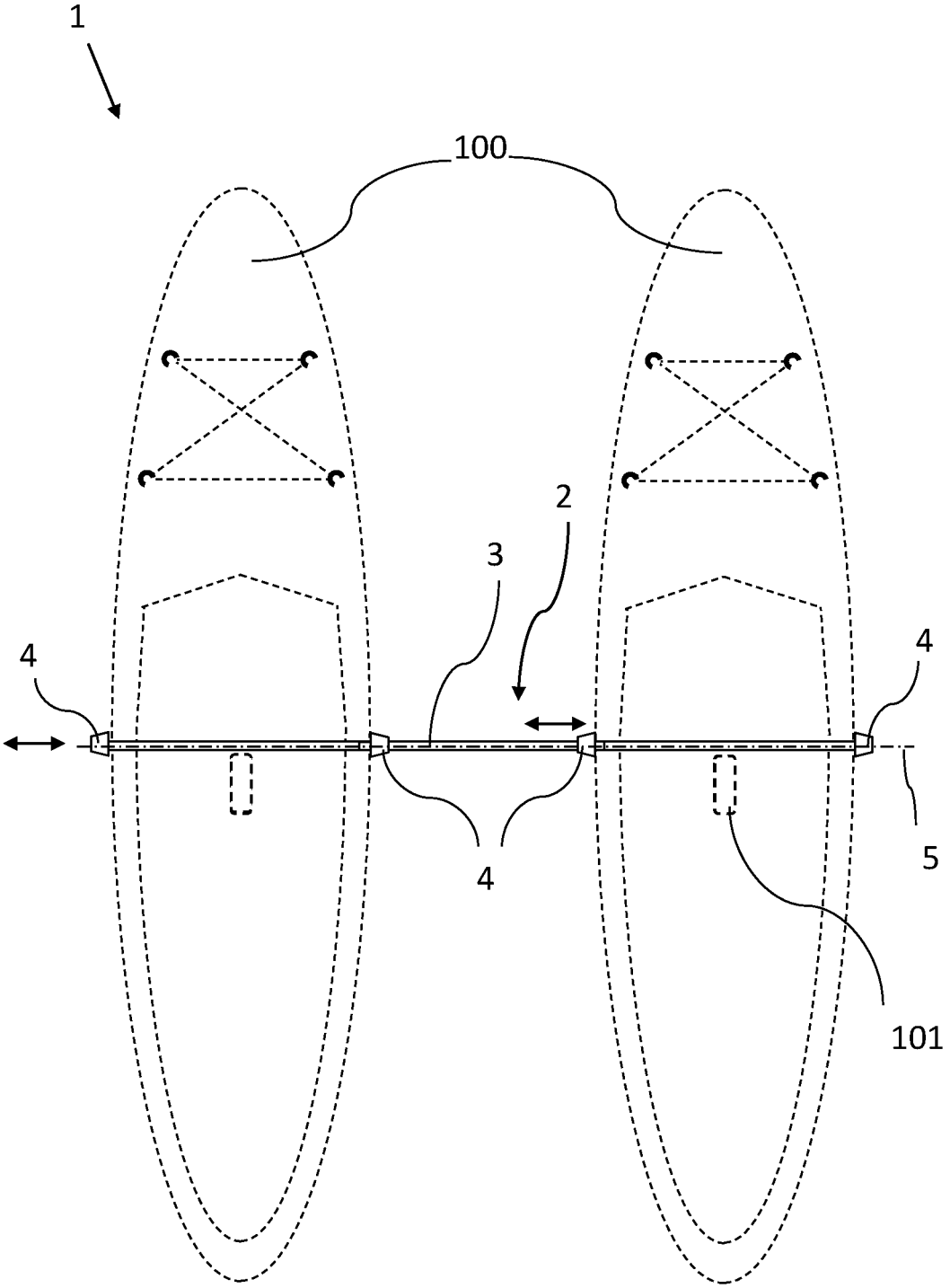

| | | | |
|---|---|---|---|
| 8,932,095 | B1 | 1/2015 | Hudson |
| 2016/0229498 | A1 | 8/2016 | Olsen |
| 2017/0043846 | A1 | 2/2017 | Elkinton |

FOREIGN PATENT DOCUMENTS

| | | | |
|---|---|---|---|
| EP | 0306697 | A1 | 3/1989 |
| IT | 201800007811 | A1 | 2/2020 |

* cited by examiner

CONNECTING DEVICE

The present invention relates to a connecting device for the connecting of at least two floating bodies side by side, in particular at least two stand-up paddle boards.

Stand-up paddling (SUP), is a water sport in which an athlete stands upright on a buoyant board called a stand-up paddle board and paddles with a stand-up paddle. For leisure sports, stand-up paddle boards are becoming more and more popular as water sports equipment. So far, stand-up paddle boards are mainly used by one person on the water. With large-volume stand-up paddle boards, the volume of one board can be enough to carry several people. The more weight a stand-up paddle board has to carry and in particular the more people are on the stand-up paddle board at the same time, the more unstable the board is on the water. In the state of the art, therefore, stand-up paddle boards can also be found, for example, which provide a large volume and a relatively wide contact surface to counteract this disadvantage.

Furthermore, there are already solutions with which individual stand-up paddle boards can also be used as kayaks, for example by means of a seat and a double paddle. The common feature of the state of the art is that generally a single stand-up paddle board is used for water sports purposes, with most variants of use only being possible for one person as intended.

It is the task of the present invention to provide a connecting device which enables new variants of application in water sports.

According to the invention, this task is solved in each case by the objects of the independent claims.

According to a first aspect of the invention, a connecting device is provided for connecting at least two floating bodies, in particular at least two stand-up paddle boards, side by side. The connecting device includes a linkage having at least one rod, and a plurality of fastening means disposed on the at least one rod of the linkage. In addition, of the plurality of fastening means, at least some of the plurality of fastening means are provided axially displaceable along the axis of the at least one rod of the linkage adapted to the respective geometry of the at least two floating bodies such that each floating body can be clamped between at least two fastening means on the at least one rod of the linkage in a positionally stable manner.

One idea underlying the present invention is to provide a modularly constructed connecting device for connecting several floating bodies to each other in such a way that a novel water sports device is created therefrom. A compact and simple handling of the present invention in the non-assembled state also plays a role, so that the connecting device can be easily transported or stored in a space-saving manner.

Accordingly, the linkage can preferably be made of light metals, in particular aluminum, of plastics or combinations thereof, and of alloys or composites of the aforementioned materials. However, the choice of materials for the linkage is not limited thereto and may also include metals or wood. Furthermore, the at least one rod of the linkage is not limited to a particular cross-section, but the cross-section of the at least one rod may be round, polygonal, oval, or a hybrid thereof, as well as any solid profile, hollow profile, or semi-open profile. For example, the at least one rod of the linkage can be designed as a MiniTec profile, a Bosch profile or a comparable profile.

Furthermore, the at least one rod can have different cross-sections in sections in order to have a specific cross-section in predetermined sections, which is only compatible with fasteners or other components designed for this specific cross-section. In this way, the assembly of the plurality of fastening means or other components on the at least one rod of the linkage can be facilitated and, in particular, incorrect assembly arrangements can be reduced. For this purpose, the at least one rod may also have pictorial and/or textual dimensional indications, which further support, for example, the symmetrical assembly of the connecting device.

The at least one rod of the linkage preferably extends substantially along its longitudinal axis or the axis of the at least one rod, where substantially means that minor curvatures are also permissible, defined up to a radius of curvature of at least about 50 m.

The at least some of the plurality of fastening means are axially displaceable along the axis of the at least one rod, in a way that the at least some of the plurality of fastening means, depending on the rod profile, either surround the at least one rod in sections or engage in the rod profile, for example by utilizing undercuts. In this case, the plurality of fastening means can further be designed to be lockable to the at least one rod in accordance with the rod profile, so that the at least some of the plurality of fastening means are axially fixed if required.

Positionally stable in the sense of the present invention means that the at least two floating bodies essentially maintain their position relative to each other, in particular their distance from each other and their alignment relative to each other, and relative to the connecting device, even under the action of forces and/or moments, and only minor elastic deformations or deviations can occur.

Advantageous embodiments and further developments result from the subclaims referring back to the independent claims as well as from the description with reference to the figures.

According to one embodiment of the connecting device, retaining clips are provided on some of the plurality of fastening means for positive or non-positive clamping around the respective floating body. Thus, the respective floating bodies can be clamped more easily in the connecting device, whereby additionally a greater variety of geometries of the floating bodies can be clamped.

According to a further development of the connecting device, the retaining clips are substantially curved and/or inclined and can be pivoted about a transverse axis of the at least one rod of the linkage. In this way, the retaining clips can be better adapted to the contour of the floating bodies and consequently the positional stability of the at least two floating bodies in the clamped state with the connecting device can be optimized.

According to a further embodiment, at least two of the plurality of fastening means have a bridging beam connecting the at least two of the plurality of fastening means for positively and non-positively enclosing the respective floating body. In this way, the respective floating body can be clamped in the connecting device in a particularly stable position, since at least two of the plurality of fastening means are coupled to one another and thus the load on the at least two of the plurality of fastening means can be additionally supported by the clamping via the bridging beam.

According to a further development, the bridging beam is coupled to the at least two of the plurality of fastening means in such a way that the linkage in interaction with the at least two of the plurality of fastening means as well as the bridging beam encloses one of the at least two floating bodies in an axis. Thus, a higher clamping effect can be achieved via a larger contact area between the fastening means, the bridging beam, the linkage and the floating bodies. Furthermore, the risk of the floating body slipping out of the clamping is reduced by completely enclosing the floating body in one axis.

According to a further embodiment, the plurality of fastening means in the contact area with the at least two floating bodies have materials for mechanical protection of the at least two floating bodies against damage, preferably foam, plastic or textiles, are at least in sections curved or round, i.e. have no edges, and/or have insert elements for mechanical protection of the at least two floating bodies against damage, preferably made of foam, plastic or textiles. Thus, the wear or damage of the at least two floating bodies can be reduced, which does not reduce the value of the at least two floating bodies or protect the floating bodies from destruction.

According to a further embodiment, the at least one rod of the linkage has an external thread at least in sections, in particular in the region of the ends of the at least one rod of the linkage or in the region of the ends and the middle of the at least one rod of the linkage. In this way, the application can be facilitated for a user, since threaded connections are generally known and relatively easy and safe to handle.

According to a further development, some of the plurality of fastening means comprise a clamping cone and a union nut, the union nut having a conical internal thread complementary to the external thread of the at least one rod of the linkage such that the clamping cone can be clamped between itself and the at least one rod of the linkage by means of the union nut in order to axially fix these fastening means relative to the at least one rod of the linkage. Thus, the some of the plurality of fastening means can be axially fixed relative to the at least one rod in the section of the external thread with a small amount of material and in a stepless manner. Thereby, the clamping cone as well as the union nut can be reversibly usable and can be fixed to the at least one rod or released from the at least one rod, respectively, without further aids.

According to a further embodiment, the at least one rod of the linkage has toothing at least in sections, in particular in the region of the ends of the at least one rod of the linkage or in the region of the ends and the center of the at least one rod of the linkage. In this way, the toothing can be formed in each case in a predetermined direction of the axis of the at least one rod with asymmetrical tooth flanks, so that the toothing has a steeper tooth flank in the predetermined direction and is thus more load-bearing than against the predetermined direction.

According to a further development, some of the plurality of fastening means have at least one engagement tooth for axially fixing the fastening means to the at least one rod of the linkage, wherein the at least one engagement tooth can be mounted on a lever pivotably supported by means of a return spring in engagement with the toothing of the at least one rod of the linkage. Thus, the some of the plurality of fasteners can be axially fixed in the section of the spline with little force and a purely translational movement of these fasteners relative to the at least one rod.

According to a further embodiment, the linkage has several rods, in particular 2 to 12 rods, and particularly preferably two, three, four, six, eight or twelve rods. In this way, the positional stability of the at least two floating bodies with respect to the connecting device can be increased with an increasing number of rods.

According to a further development, the several rods, in particular the two, three, four, six, eight or twelve rods of the linkage, are each connected to each other via a plug-in connection, such as a spring button clamp, a bayonet lock or the like, via a clamp connection or via a screw connection, such as a pinch screw connection or the like, for varying their longitudinal extension adapted to the geometries of the at least two floating bodies. Thus, the at least two floating bodies can each first be independently clamped into the plurality of rods of the linkage before subsequently the plurality of rods, each clamping one of the at least two floating bodies, can be connected to each other. This can, for example, simplify the assembly process on land, making the at least two floating bodies easier to handle and, in particular, to carry to water.

According to a further embodiment, two of the plurality of rods, in particular the two, three, four, six, eight or twelve rods of the linkage, extend substantially parallel to each other and are enclosed in sections by a strap of one of the at least two floating bodies, wherein the two rods extending substantially parallel to each other can be mounted suitably spaced apart from each other for tensioning the strap. Thus, the at least two floating bodies can be fixed in their distance from the at least one rod of the linkage. This can reduce the risk of the floating body slipping out of the clamping.

According to a further embodiment, the at least one rod of the linkage has a tensioning device for tensioning a strap of one of the at least two floating bodies. Thus, the at least two floating bodies can be fixed in their distance from the at least one rod of the linkage. This can reduce the risk of the floating body slipping out of the clamping.

According to a further embodiment, the connecting device further comprises at least one connecting element configured to detachably attach an add-on component, such as a base plate, a seat, a table, a ladder, a rudder, an outboard motor or the like, to the linkage for modular extension of the connecting device. Thus, it is possible to attach different types of add-on components to each other and/or to the linkage by means of uniformly designed connecting elements.

According to a further development of the connecting device, the at least one connecting element is designed as a tilting eccentric lever for pressing cone-shaped segments apart in through holes, and the linkage has through holes with a complementary hole diameter. In this way, to attach the add-on component to the linkage, access to a connection point is only required from one side, since the rocker eccentric lever can be inserted and locked from the same attachment side of the connection point. This means that the attachment component can also be fastened at connection points that are difficult to reach.

According to a further development of the connecting device, the at least one connecting element is designed as a clip for pressing the clip onto the linkage in order to couple the attachment component to the linkage in a positive or non-positive manner, and/or as a socket for plugging on the linkage, the linkage having a spring button clip for the form-fitting connection of the linkage to the attachment component. In this way, the add-on component can be attached to the linkage regardless of the cross-section of the at least one rod, as long as the diameter or edge length of the cross-section lies in a range that can be enclosed by the clip.

According to a second aspect of the invention, there is provided a system comprising two floating bodies (100), in particular comprising two stand-up paddle boards, more preferably comprising two inflatable stand-up paddle boards, and a connecting device (1) according to any one of the preceding claims.

According to another aspect of the invention, there is provided a connection method for connecting at least two floating bodies, in particular two stand-up paddle boards, side by side. The connecting method comprises the steps of (a) providing at least two floating bodies and a connecting device comprising:

a linkage comprising at least one rod; and a plurality of fastening means arranged on the at least one rod of the linkage, at least some of the plurality of fastening means being axially displaceable along the axis of the at least one rod of the linkage adapted to the respective geometry of the at least two floating bodies in such a way that each floating body can be clamped between at least two fastening means on the at least one rod of the linkage in a stable position;

in particular a connecting device according to the invention;

(b) arranging the plurality of fastening means on the at least one rod of the linkage;

(c) adapting at least some of said plurality of fastening means to the respective geometry of said at least two floating bodies;

(d) clamping a first of said at least two floating bodies between at least two fastening means, in particular between half of said plurality of fastening means, to said at least one rod of said linkage;

(e) repeating steps (c) and (d) for each additional one of said at least two floating bodies.

According to one embodiment of the connection method, the method further comprises the step of (f) releasably connecting at least two of the at least one rod of the linkage to vary their longitudinal extension adapted to the geometries of the at least two floating bodies by a plug-in connection, such as a spring button clamp, a bayonet lock or the like, or by a screw connection, such as a pinch screw connection or the like.

The above embodiments and further embodiments can be combined with each other as desired, if useful. Further possible embodiments, further developments and implementations of the invention also include combinations, not explicitly mentioned, of features of the invention described before or below with respect to the embodiments. In particular, the skilled person will thereby also add individual aspects as improvements or additions to the respective basic form of the present invention.

Figure 2:
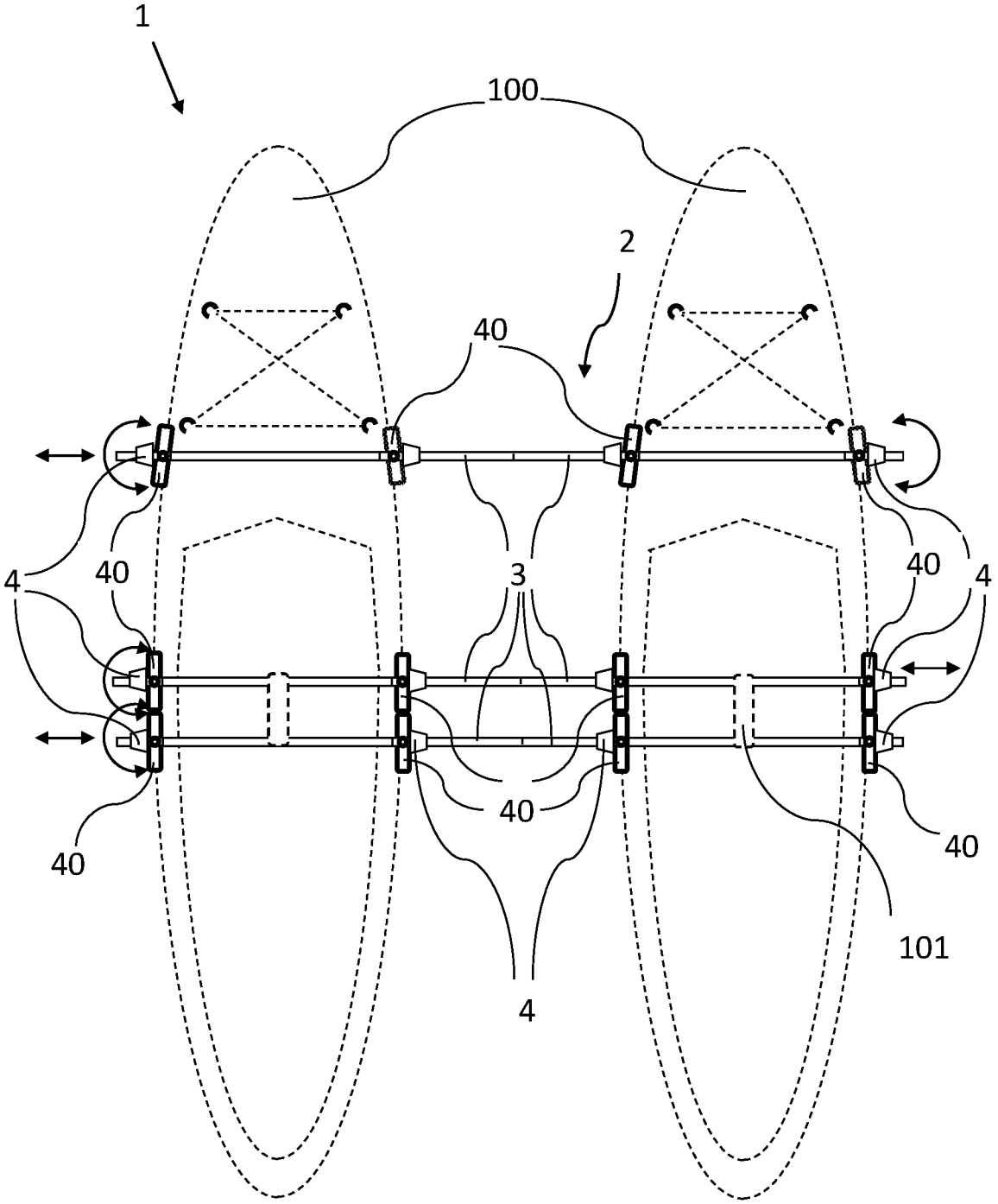
Figure 3:
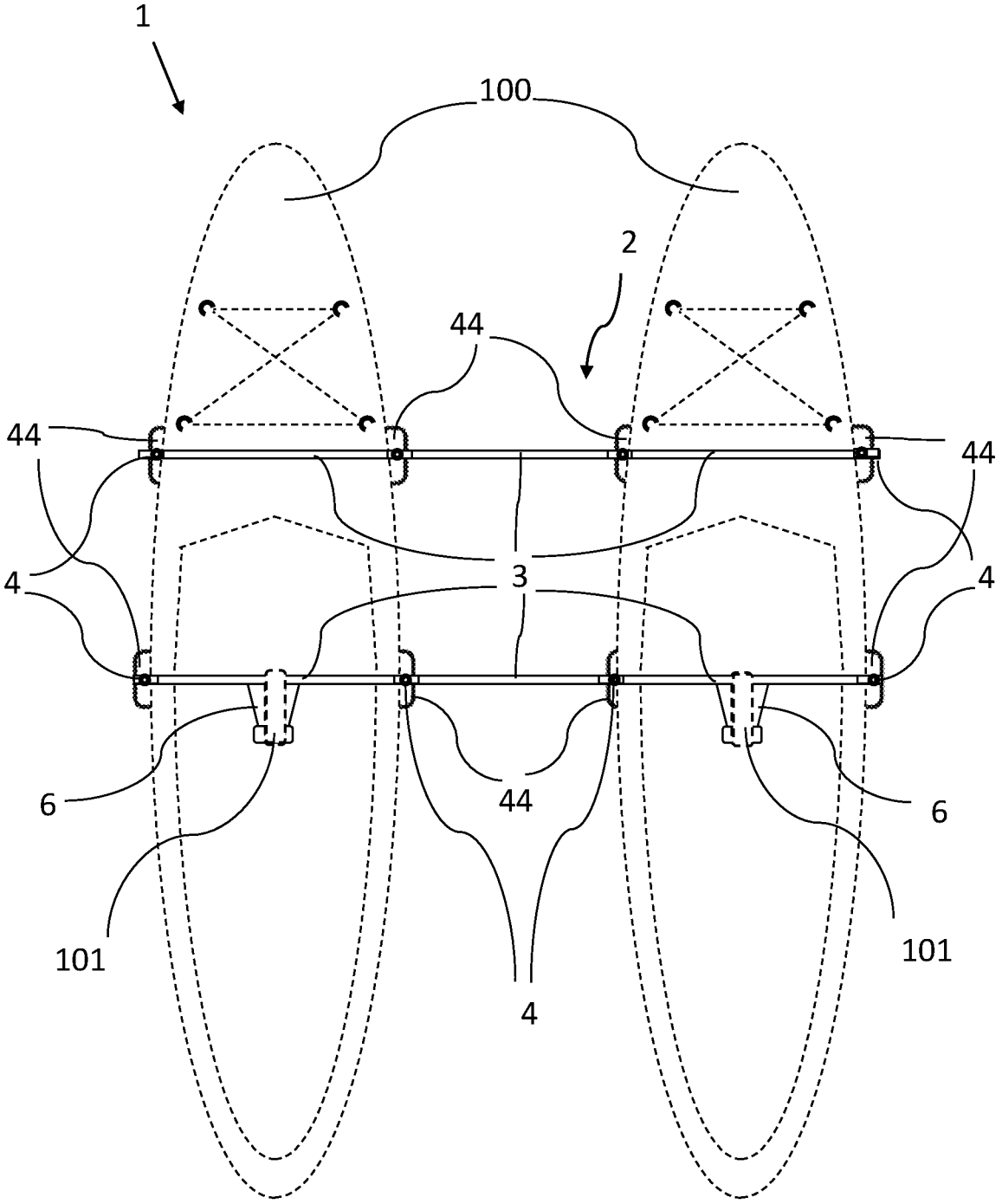
Figure 4A:
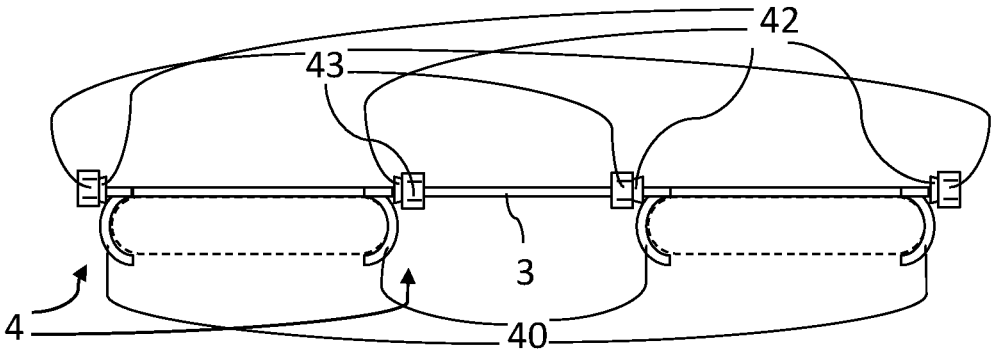
Figure 4B:
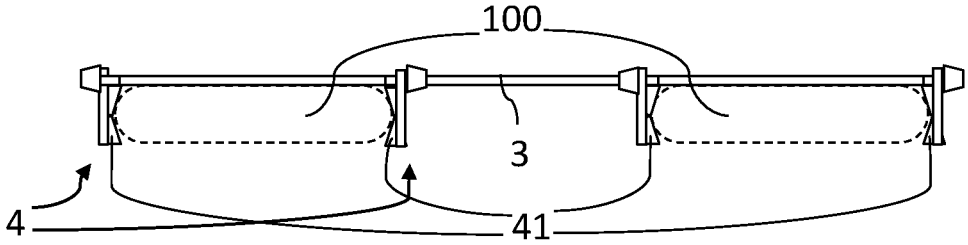
Figure 4C:
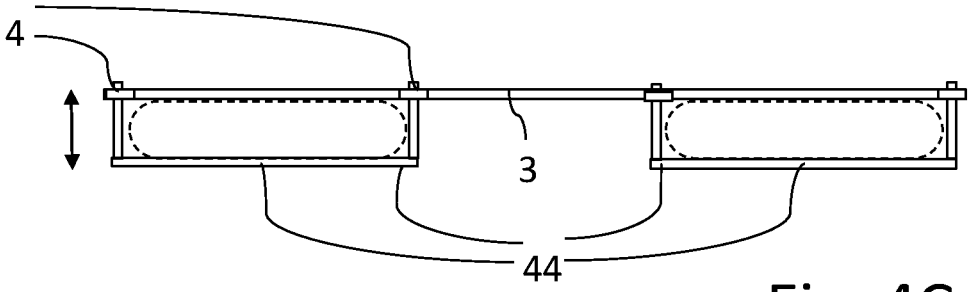
Figure 4D:
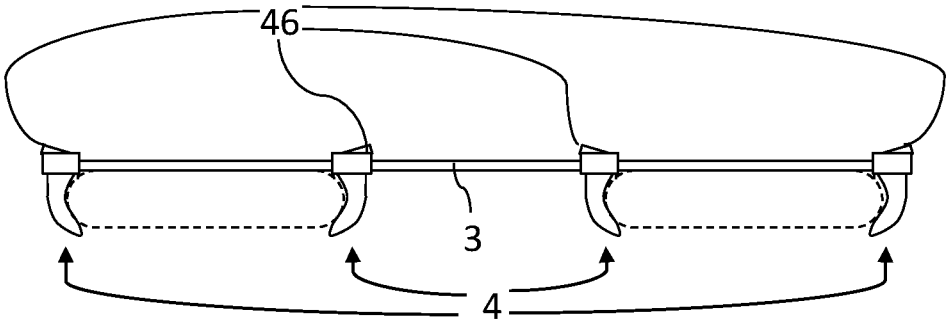
Figure 5:
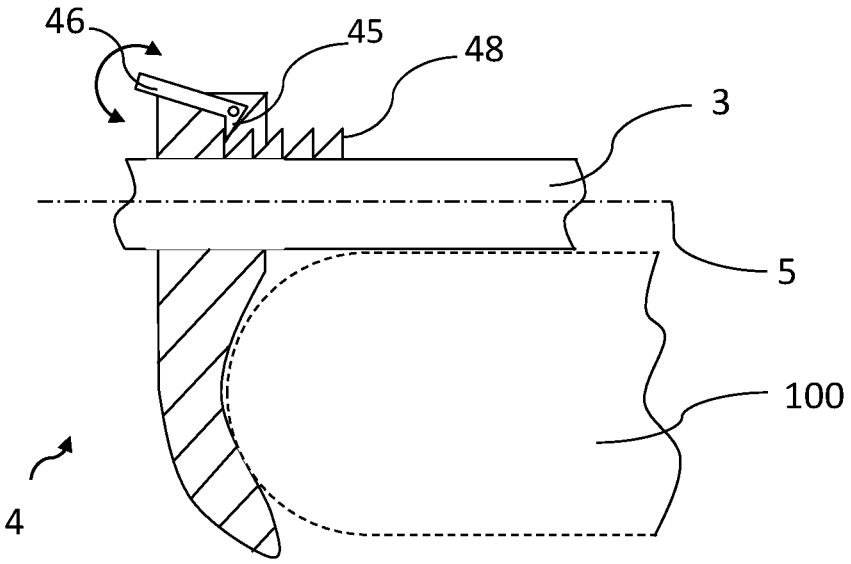
Figure 6A:
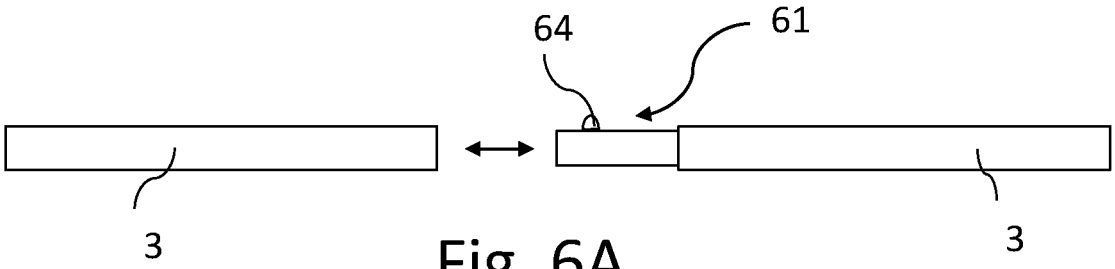
Figure 6B:
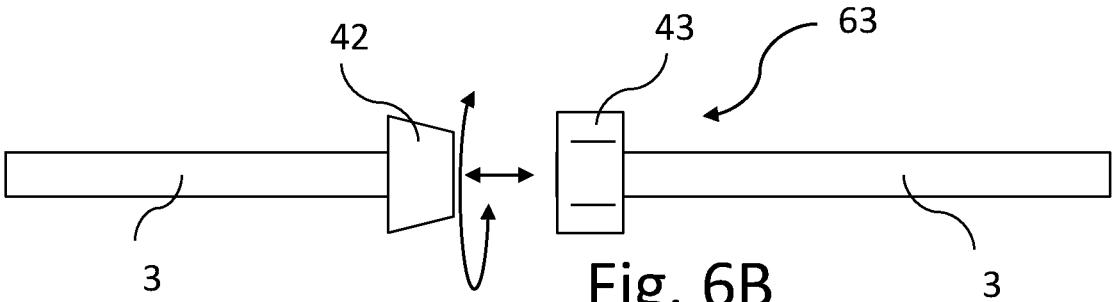
Figure 6C:
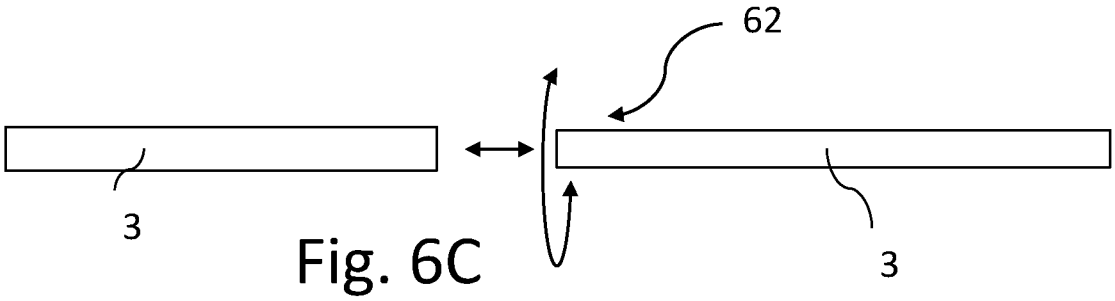
Figure 7A:
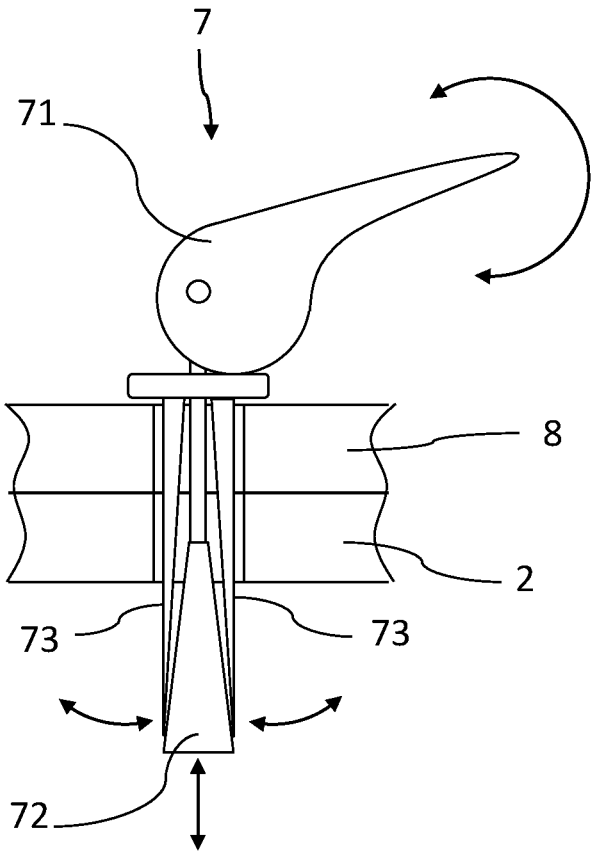
Figure 7B:
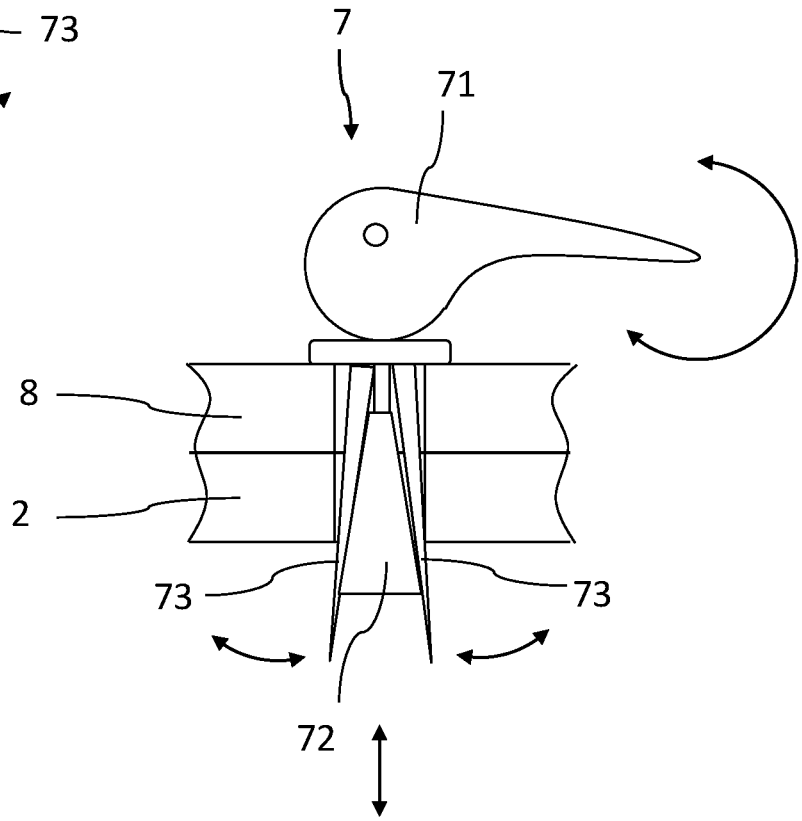
Figure 9:
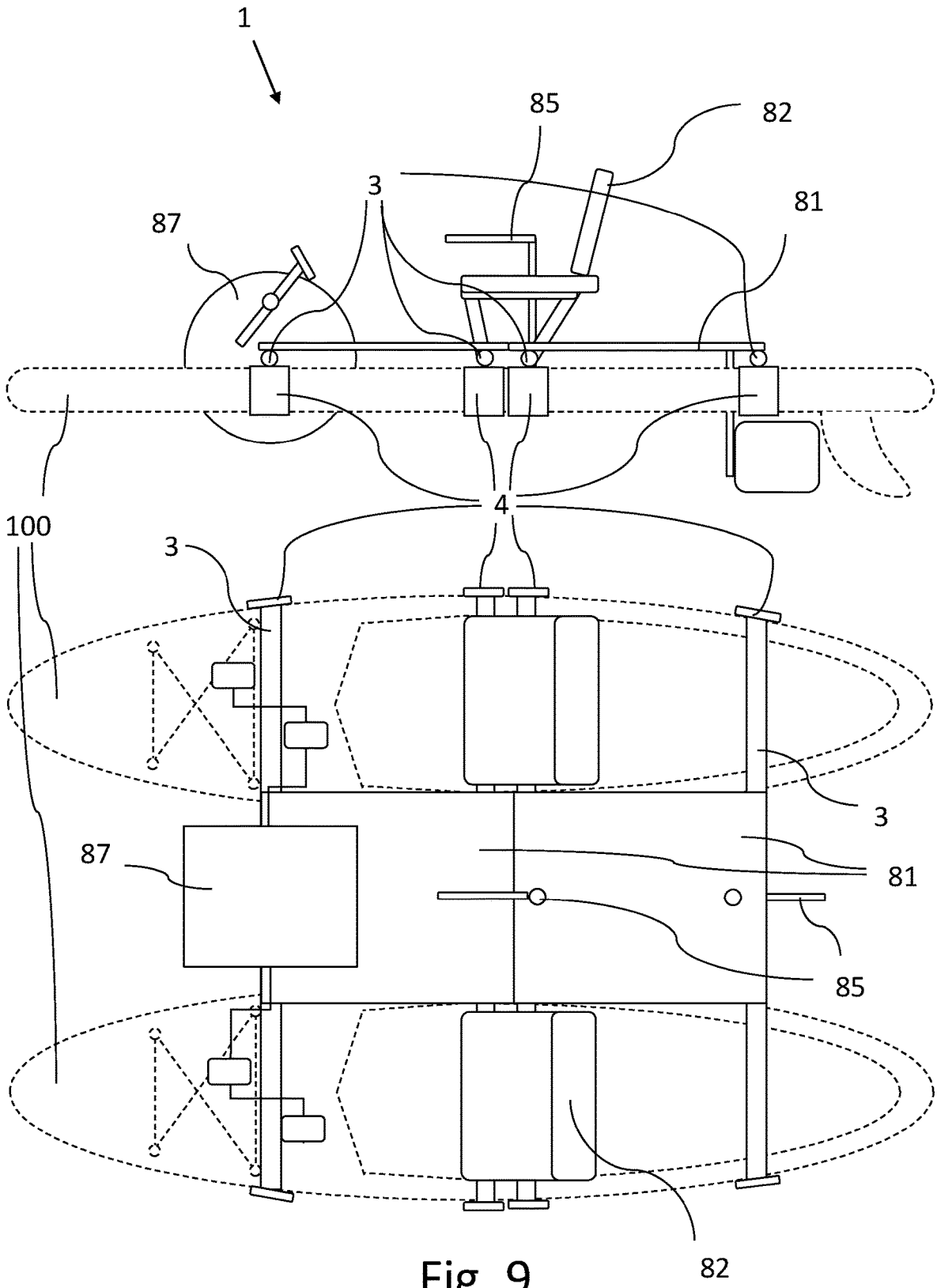
Figure 10:
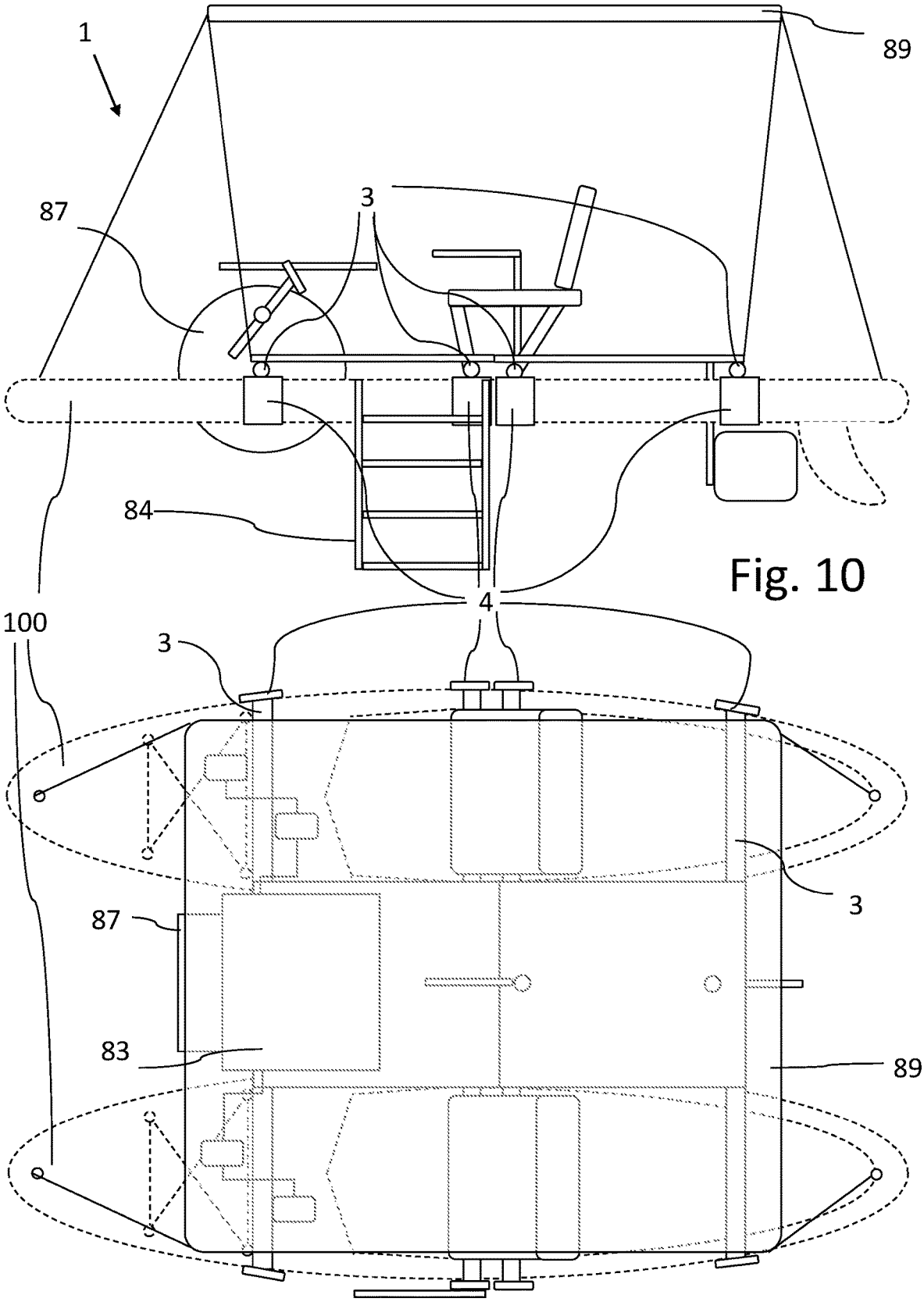
Figure 11:
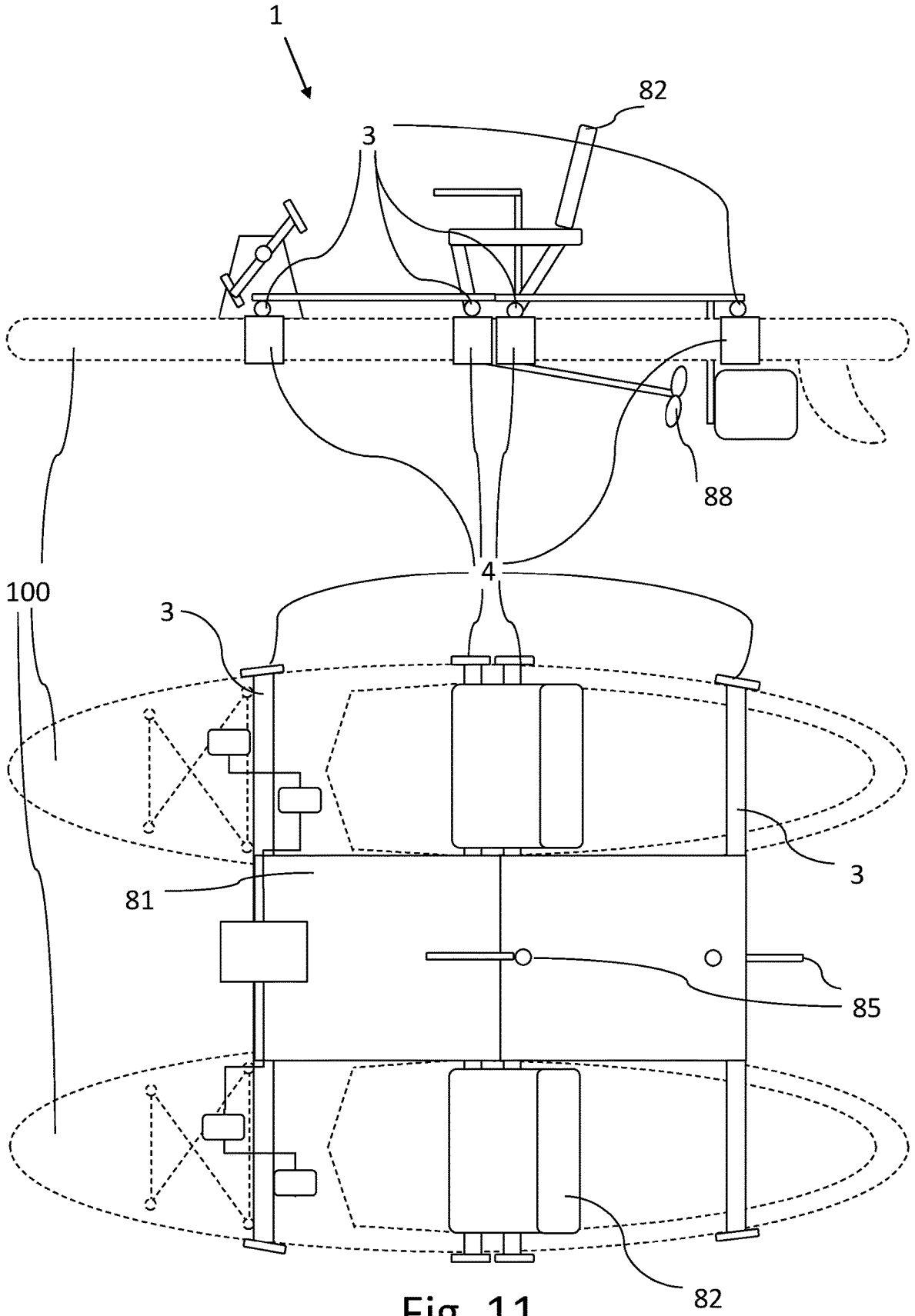
Figure 12:
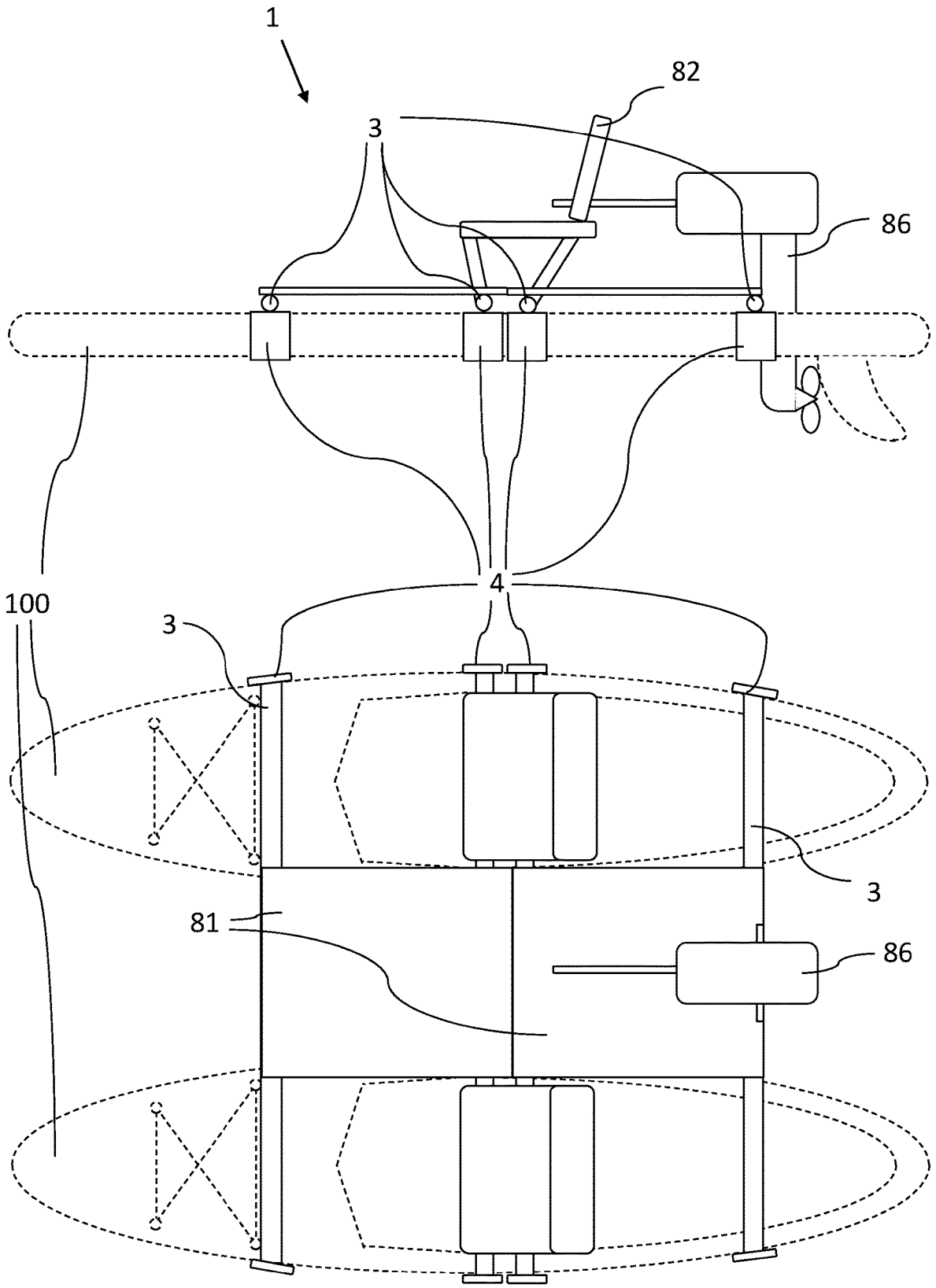
Figure 13:
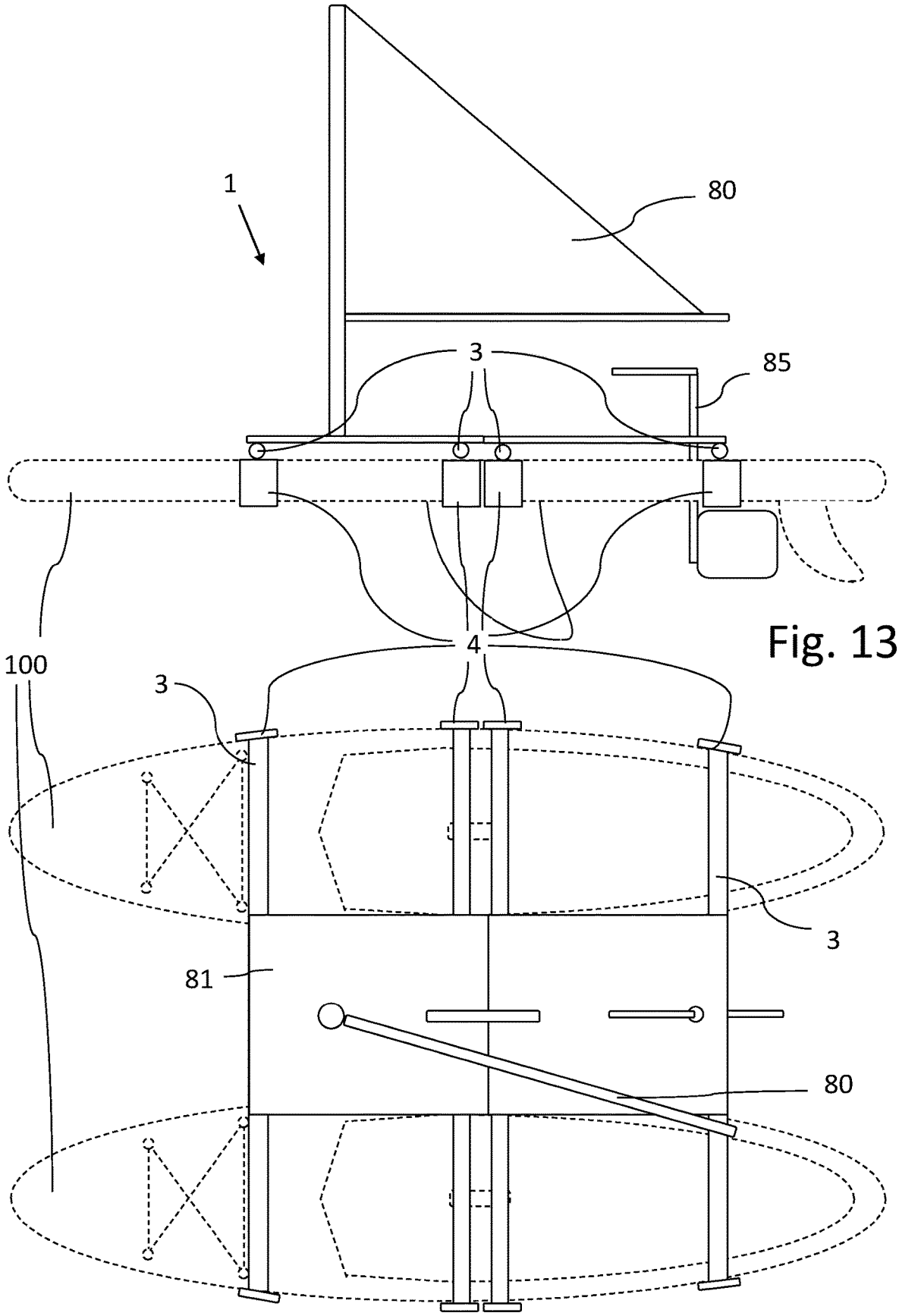

The present invention is explained in more detail below with reference to examples of embodiments shown in the accompanying figures of the drawings. The following figures listed show:

FIG. 1 a schematic view of a connecting device according to one embodiment of the invention;

FIG. 2 a schematic view of a connecting device according to a further embodiment of the invention;

FIG. 3 a schematic view of a connecting device according to a further embodiment of the invention;

FIGS. 4A, 4B, 4C, 4D schematic front views of a respective plurality of fastening means in the longitudinal direction of floating bodies according to embodiments of the invention;

FIG. 5 a schematic detailed view of a fastener with an engagement tooth according to the embodiment example of FIG. 4D;

FIGS. 6A, 6B, 6C schematic side views of a respective linkage with a plurality of rods, which can be connected to each other via a plug-in connection (FIG. 6A), a screw connection (FIG. 6B) or a clamp connection (FIG. 6C), according to embodiments of the invention;

FIGS. 7A, 7B a schematic view of a connecting element according to one embodiment of the invention, wherein the connecting element is in a non-locked state in FIG. 7A and in a locked state in FIG. 7B;

FIGS. 8A, 8B, 8C, 8D each a schematic front view and a schematic side view of a connecting element according to further embodiments of the invention;

FIG. 9 a schematic top view and a schematic side view of a connecting device in use as a pedal boat with a water wheel according to a further embodiment of the invention;

FIG. 10 a schematic top view and a schematic side view of a connecting device in use as a pedal boat according to the embodiment example according to FIG. 9 with further attachment components;

FIG. 11 a schematic top view and a schematic side view of a connecting device in use as a pedal boat with a propeller according to a further embodiment example of the invention;

FIG. 12 a schematic top view and a schematic side view of a connecting device in use as a motorboat according to a further embodiment of the invention;

FIG. 13 a schematic top view and a schematic side view of a connecting device in use as a sailboat according to a further embodiment of the invention.

In the figures of the drawing, identical elements, features and components with the same function and the same effect are each given the same reference signs, unless otherwise stated.

Although specific embodiments and further embodiments are illustrated and described herein, those skilled in the art will prefer that a variety of alternative and/or like embodiments may be substituted for the specific embodiments illustrated and described without departing from the scope of the present invention. This application is generally intended to cover any variations or modifications of the specific embodiments described herein.

The accompanying figures are intended to provide a further understanding of embodiments of the invention and, in connection with the description, serve to explain principles and concepts of the invention. Other embodiments and many of the advantages mentioned will be apparent with reference to the drawings. The drawings are to be understood as schematic drawings only, and the elements of the drawings are not necessarily shown to scale with respect to each other. Directional terminology such as "top", "bottom", "left", "right", "above", "below", "horizontal", "vertical", "front", "rear" and the like are used for explanatory purposes only and are not intended to limit generality to specific embodiments as shown in the figures.

FIG. 1 shows a schematic view of a connecting device 1 according to an embodiment example of the present invention. In this embodiment example, the connecting device 1 comprises a linkage 2 with a rod 3 as well as four fastening means 4. Thereby, the connecting device 1 connects two floating bodies 100 side by side, wherein the two floating bodies are exemplarily shown in the form of two stand-up paddle boards 100. The two stand-up paddle boards 100 are preferably clamped in a positionally stable manner by the connecting device 1 in their central region or at their widest points, that is to say approximately at the height of straps 101 of the stand-up paddle boards 100.

The four fastening means 4 are arranged on the rod 3 of the linkage 2. Furthermore, at least two of the four fastening means 4 are provided axially displaceable along the axis 5 of the rod 3 of the linkage 2 adapted to the respective geometry of the two stand-up paddle boards 100 in such a way that each stand-up paddle board 100 can be clamped between two fastening means 4 on the rod 3 of the linkage 2 in a stable position. The axial displaceability of the fastening means 4 is illustrated by double arrows in FIG. 1. Alternatively, three of the four or all four fastening means 4 can also be provided so as to be axially displaceable.

FIG. 2 shows a schematic view of a connecting device 1 according to a further embodiment example of the invention.

In the embodiment example according to FIG. 2, the connecting device 1 comprises a linkage 2 with six rods 3 as well as twelve fastening means 4. Thereby, the connecting device 1 connects two floating bodies 100 side by side, wherein the two floating bodies are exemplarily shown in the form of two stand-up paddle boards 100.

Two fastening means 4 are preferably arranged on each of the six rods 3 of the linkage 2. Two of the six rods 3 of the linkage 2 are each connected to each other via a plug-in connection for varying their longitudinal extension adapted to the geometries of the two stand-up paddle boards 100. The six rods 3 either have identical lengths, as in this embodiment example, or may have different lengths.

In this case, two rods 3 of the linkage 2 can extend essentially parallel to each other on at least one of the stand-up paddle boards 100 and be enclosed in sections by a strap 101 of one of the at least two stand-up paddle boards 100. In FIG. 2, the rods 3 of the linkage 2 are arranged in an exemplary manner such that two rods 3 are each enclosed by the straps 101 of the two stand-up paddle boards 100. Further, the two rods 3 extending substantially parallel to each other are suitably mounted widely spaced apart from each other in the central region of the stand-up paddle boards 100 for tensioning the strap 101. The other two of the six rods 3 are mounted in a front region of the stand-up paddle boards 100.

Furthermore, at least six of the twelve fastening means 4 are provided axially displaceable along the axis 5 of the respective rod 3 of the linkage 2 adapted to the respective geometry of the two stand-up paddle boards 100 in such a way that each stand-up paddle board 100 can be clamped between two fastening means 4 on the rod 3 of the linkage 2 in a stable position. The axial displaceability of the fastening means 4 is illustrated by means of double arrows, whereby for reasons of clarity not every axially displaceable fastening means 4 has been assigned a double arrow. Alternatively, more than six of the twelve fasteners 4 may be axially displaceable.

The twelve fastening means 4 may further comprise retaining clips 40 for positive or non-positive clamping around the respective stand-up paddle board 100. In this respect, the retaining clips 40 may be substantially curved and pivotable about a transverse axis of the rod 3. Preferably, the retaining clips 40 are bent such that their shape substantially corresponds to the shape of the stand-up paddle board 100 in the respective contact area. Alternatively or additionally, the retaining clips 40 may be substantially oblique in shape and pivotable about a transverse axis of the rod 3. The pivotability of the retaining clips 40 is illustrated with reference to arcuate double arrows in FIG. 2, although for reasons of clarity not every pivotable retaining clip 40 has been assigned an arcuate double arrow. Alternatively, more than the retaining clips 40 shown can be provided so as to be pivotable about a transverse axis of the rod 3.

FIG. 3 shows a schematic view of a connecting device 1 according to a further embodiment example of the invention.

In the embodiment example according to FIG. 3, the connecting device 1 comprises a linkage 2 with six rods 3 as well as eight fastening means 4. Thereby, the connecting device 1 connects two floating bodies 100 side by side, the two floating bodies being shown exemplarily in the form of two stand-up paddle boards 100.

Three of the six rods 3 of the linkage 2 are each connected to each other by a screw connection for varying their longitudinal extension adapted to the geometries of the two stand-up paddle boards 100. According to the present embodiment example, the six rods 3 have different lengths, with the respective middle rod 3 of the three interconnected rods 3 being shorter than the two outer rods 3 of the three interconnected rods 3. The two outer rods 3 of the three interconnected rods 3 are in particular longer than the width of the stand-up paddle boards 100 at their widest point. Optionally, the rods 3 can have identical lengths, provided that three of the rods 3 are formed longer in total than twice the width of the widest point of the stand-up paddle board 100.

In addition, two of the eight fastening means 4 may each have a bridging beam 44 connecting the two fastening means 4 for positive or non-positive enclosure of the respective stand-up paddle board 100. The bridging beams 44 are attached, for example, to undersides of the fastening means 4 via a screw or clamp connection. Alternatively, the bridging beams 44 may be variable in their longitudinal extension in order to be adaptable to the geometry of the stand-up paddle board 100.

Furthermore, in FIG. 3, two of the six rods 3 of the linkage 2 have a tensioning device 6 for tensioning a strap 101 of the respective stand-up paddle board 100.

FIGS. 4A, 4B, 4C and 4D show schematic front views of a respective plurality of fastening means 4 in the longitudinal direction of floating bodies 100 according to embodiments of the invention.

In FIG. 4A, according to an embodiment example of the plurality of fastening means 4, the rod 3 of the linkage 2 has an external thread at least in sections. The external thread may also be provided only in the region of the ends of the rod 3 of the linkage 2, if the fastening means 4 are not axially displaceable in the middle of the rod 3. Optionally, the external thread may be provided in the area of the ends and the center of the rod 3 of the linkage 2 so that all fastening means 4 are axially displaceable along the rod 3.

In the embodiment example according to FIG. 4A, the fastening means 4 exemplarily comprise a clamping cone 42 and a union nut 43 or a clamping fitting. In this case, the union nut 43 can have a conical internal thread complementary to the external thread of the rod 3 of the linkage 2 in such a way that the clamping cone 42 can be clamped between itself and the rod 3 of the linkage 2 by means of the union nut 43 in order to fix the fastening means 4 axially relative to the rod 3 of the linkage 2. The union nut 43 has a larger internally threaded concentric opening on one side and a slightly smaller concentric opening on the opposite side, which corresponds approximately to the diameter of the rod 3. Starting from the smaller opening, the inner diameter of the internal thread widens conically to the diameter of the larger opening. The clamping cone 42 is further adapted to be clamped between the rod 3 and the union nut 43 when, during tightening of the union nut 43, the conical internal thread thereof pushes onto the clamping cone 42 and squeezes the clamping cone 42. For this purpose, the clamping cone 42 is preferably made of a soft material, in particular silicone, plastic, rubber or a comparable material.

In FIG. 4B, the fastening means 4 in the contact area to the two illustrated floating bodies 100 accommodate insert elements 41 for mechanical protection of the two floating bodies 100 against damage. The insert elements 41 are preferably made of foam, plastic or textiles. Furthermore, the insert elements 41 are in particular substantially adapted to the geometry of the floating bodies 100, wherein one or more insert elements 41 can be accommodated in each fastening means 4. Alternatively, the fastening means 4 have materials in the contact area to the two illustrated floating bodies 100 for mechanical protection of the at least two floating bodies 100 against damage, preferably foam, plastic or textiles.

FIG. 4C illustrates the fastening means 4 in combination with the bridging beam 44 of FIG. 3. In particular, FIG. 4C illustrates that the bridging beam 44 may be coupled to the at least two of the plurality of fastening means 4 such that the linkage 2 in interaction with the fastening means 4 as well as the bridging beam 44 encloses the floating body 100 along an axis.

In the embodiment shown in FIG. 4D, the rod 3 of the linkage 2 has toothing 48 including a number of teeth (details shown in FIG. 5,) at least in sections. The toothing 48 can also be provided only in the area of the ends of the rod 3 of the linkage 2, if the fastening means 4 are not axially displaceable in the middle of the rod 3. Optionally, the toothing 48 can be provided in the area of the ends and the center of the rod 3 of the linkage 2, so that all fastening means 4 are axially displaceable along the rod 3. For displacing or releasing the fastening means 4 relative to the rod 3, the plurality of fastening means 4 may comprise a lever 46.

FIG. 5 shows a schematic detailed view of a fastener 4 with an engagement tooth 45 according to the embodiment example in FIG. 4D.

In addition to the features of the embodiment example according to FIG. 4D, the fastening means 4 may have an engagement tooth 45 for axially fixing the fastening means 4 to the rod 3 of the linkage 2, as shown in FIG. 5. Optionally, the fastening means 4 may also have several engagement teeth 45. In this case, the engagement tooth 45 can preferably be mounted on the lever 46 in engagement with the teeth of the toothing 48 of the rod 3 of the linkage 2. Furthermore, the lever 46 can be pivotably mounted on the fastening means 4 by means of a return spring.

FIGS. 6A, 6B and 6C show schematic side views of a respective linkage 2 with several rods 3, which can be connected to each other via a plug-in connection (FIG. 6A), a screw connection (FIG. 6B) or a clamp connection (FIG. 6C), according to embodiments of the invention.

In FIG. 6A, the plug-in connection is illustrated in particular as a spring button clip 61. Here, a first of the rods 3 to be connected has a hollow profile at least in an end region of the first rod 3 and a hole in the shell of the first rod 3 in this end region. A second of the rods 3 to be connected has outer dimensions complementary to inner dimensions of the hollow section in an end region of the second rod 3, and a spring button 64. The bore and the spring button 64 are preferably matched in their dimensions as well as positions in relation to the respective rods 3, so that the spring button 64 locks in the bore when the first and second rods 3 are pushed into each other. Thus, the rods 3 of the linkage 2 can be precisely positioned and also quickly released again by means of the spring button clip 61. Alternatively, the plug-in connection can also be designed as a bayonet lock or similar.

FIG. 6B shows an example of a screw connection designed as a pinch screw connection 63. A first of the rods 3 to be connected preferably has a clamping cone 42 in its end region. A second of the rods 3 to be connected preferably has a union nut 43 in its end region. Further, the clamping cone 42 and the union nut 43 are, for example, fixedly connected to the respective rod 3 so that the first and the second rod 3 are not allowed to move relative to each other in the connected state. For further explanation of the pinch screw connection 63, reference is made to the description with respect to the embodiment example according to FIG. 4A. Furthermore, similar screw connections are also possible, by means of which the longitudinal extension of the rods 3 of the linkage 2 can be variably adapted to the geometries of the floating bodies 100.

Optionally, a first and a second rod 3 can also be connected to each other via a clamping connection 62, as illustrated in FIG. 6C. Particularly preferably, the clamping connection 62 is in the form of a telescopic rod, wherein the first and second rods 3 can be fixed in known manner by twisting the rods 3 relative to one another or by closing a bracket on the first or second rod 3, the first rod 3 being fixed in relation to the second rod 3.

FIGS. 7A and 7B show a schematic view of a connecting element 7 according to an embodiment of the invention, wherein the connecting element 7 is in a non-locked state in FIG. 7A and in a locked state in FIG. 7B.

The at least one connecting element 7 can be designed to detachably attach an add-on component 8, such as a base plate, a seat, a table, a ladder, a rudder, an outboard motor or the like, to the linkage 2 for modular extension of the connecting device 1. In this regard, the at least one connecting element 7 is preferably configured as a tilting eccentric lever 7. The tilting eccentric lever 7 has, for example, a cone 72 which is connected to a lever element 71 of the tilting eccentric lever 7 via a cylindrical stem and widens in cross-section from a proximal end towards a distal end. Furthermore, the tilting eccentric lever 7 has segments 73 arranged substantially conically or substantially circularly around the stem and the cone 72, the segments 73 being pivotally mounted.

In order to be able to fasten the add-on component 8 to the linkage 2, the add-on component 8 can in particular have through holes or recesses. Accordingly, the linkage 2 can also in particular have through holes with a complementary hole diameter. As FIG. 7A illustrates, the add-on component 8 and the linkage 2 are arranged relative to each other in such a way that the respective through bores lie one above the other and the tilting eccentric lever 7 can be inserted into the through bores from at least one side.

In the locked state, the cone 72 presses the segments 73 apart by displacing the cone 72 by flipping the lever element 71 so that the tilting eccentric lever 7 is locked, in particular frictionally, in the through holes, as shown in FIG. 7B.

FIGS. 8A, 8B, 8C and 8D each show a schematic front view and a schematic side view of a connecting element 7 according to further embodiments of the invention.

Figure 8A:
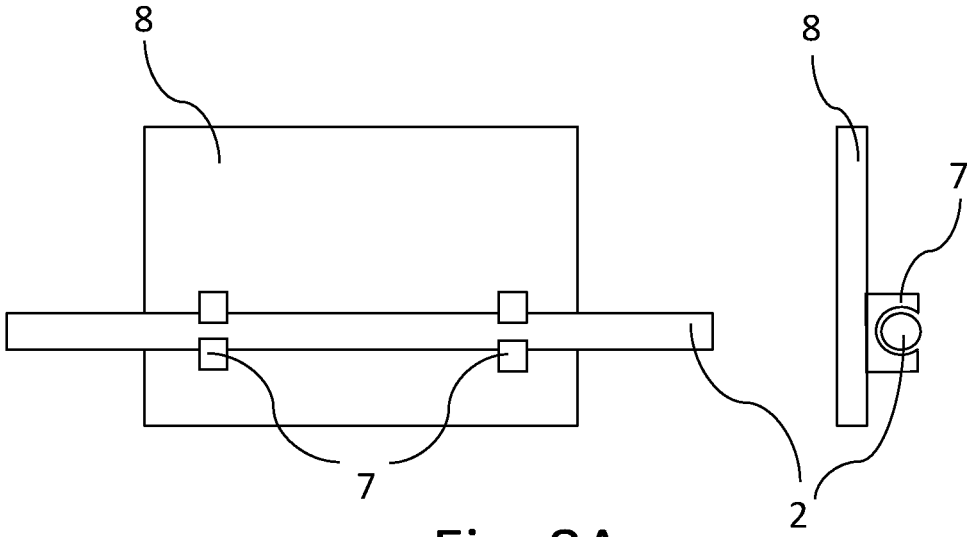
Figure 8B:
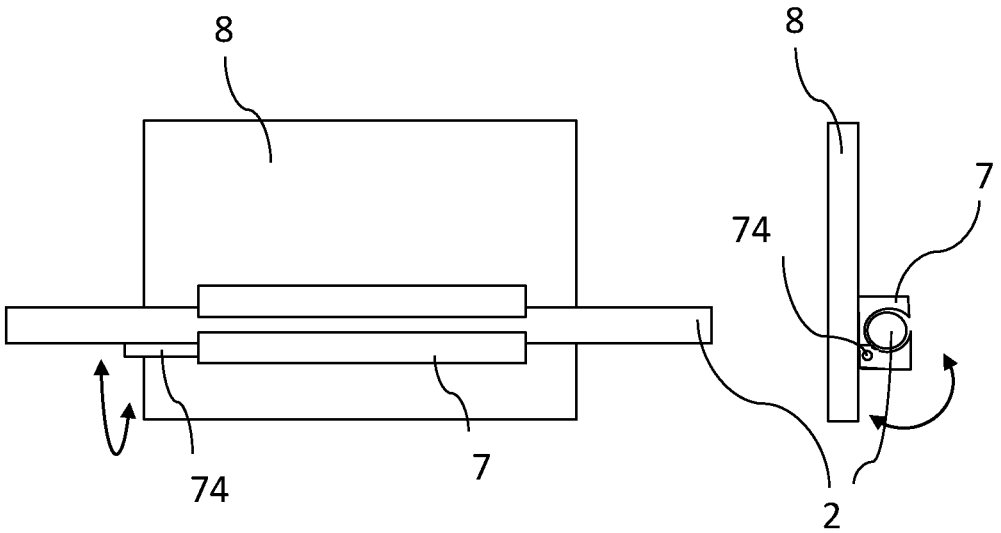

In FIGS. 8A and 8B, the connecting element 7 is designed as a clip 7 by way of example. The clip 7 can be pressed onto the linkage 2, wherein the clip 7 is made in particular of a soft material, in particular of silicone, plastic, rubber or comparable material. The connecting element 7 may further be configured to detachably attach an add-on component 8, such as a base plate, a seat, a table, a ladder, a helm, an outboard motor or the like, to the linkage 2 for modular extension of the connecting device 1. Optionally, the add-on component 8 may include one or more clips 7 to positively and/or non-positively couple the add-on component 8 to the linkage 2.

In particular, FIG. 8B shows a clip 7 with a locking mechanism 74. The locking mechanism 74 is preferably pivotally mounted on the clip 7. By pivoting the locking mechanism 74, a latch provided in the clip 7 can close an interruption of the clip 7 in the circumferential direction of the linkage 2, so that the linkage 2 is now completely enclosed by the clip 7 and the latch.

Figure 8C:
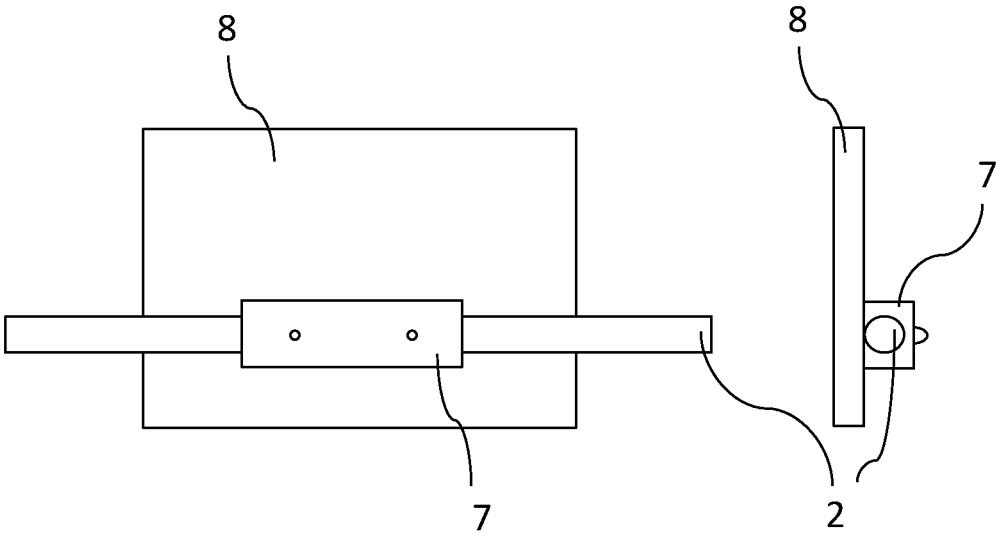
Figure 8D:
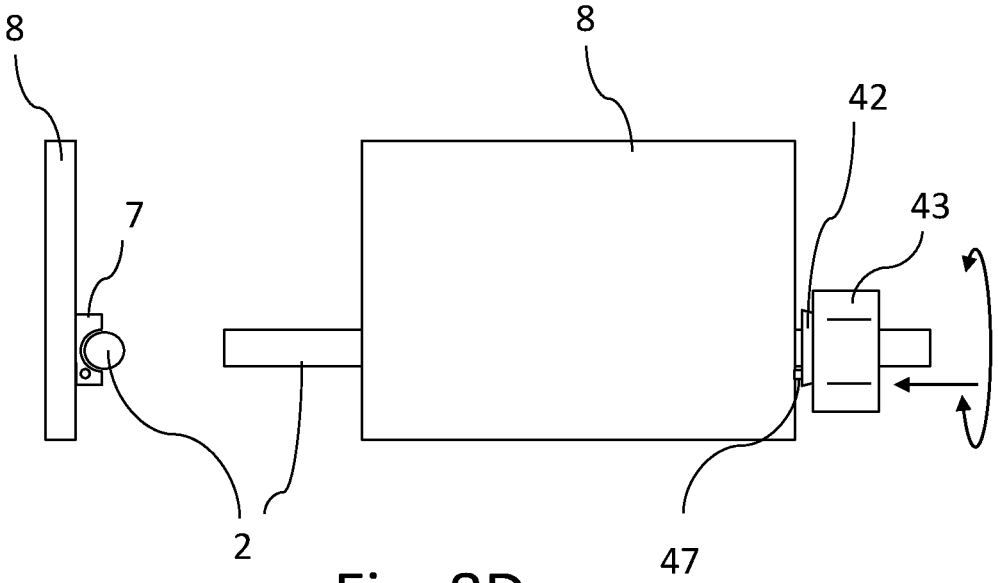

Alternatively or additionally, the connecting element 7, as shown in FIG. 8C, can be designed, for example, as a socket 7 for plugging on the linkage 2. In this case, the linkage 2 preferably has a spring button clip according to the embodiment example in FIG. 6A. The plug-in socket 7 may be integrated in the add-on component 8 or mountable thereon. The linkage 2 is designed to be insertable into the socket 7 and thus to positively connect the add-on component 8 to the linkage 2. In particular, several rods 3 can be plugged into the socket 7 from different sides.

In addition, the connecting element 7 can also have a clamping cone 42 and a union nut 43 similar to the embodiment example according to FIG. 4A. In this case, the clamping cone 42 in the embodiment example according to FIG. 8D further has a positioning pin 47. By means of the positioning pin 47, which can be inserted into a recess of a clip 7 or the add-on component 8, the clamping cone 42 can be fixed radially with respect to the clip 7 or the add-on component 8 or the linkage 2.

FIGS. 9 to 13 show various uses of a connection device 1 in combination with two stand-up paddle boards 100 for one or more people, with exemplary add-on components 8 shown.

FIG. 9 shows a schematic top view and a schematic side view of a connecting device 1 in use as a pedal boat with a water wheel 87 according to a further embodiment of the invention.

The connecting device 1 preferably has four rods 3, wherein two of the four rods 3 are arranged in a central region of the stand-up paddle boards 100 and the remaining two of the four rods 3 are arranged in a front and rear region, respectively, of the stand-up paddle boards 100. The connecting device 1 may further comprise, for example, add-on components 8 such as two base plates 81, two seats 82, a steering rudder 85, and the water wheel 87. Said add-on components 8 are detachably attached to the linkage 2, in particular by means of at least one of the connecting components 7 presented in FIGS. 7A, 7B, 8A, 8B, 8C or 8D. Alternatively or additionally, the add-on components 8 are fastened to each other or mutually supported.

The two base plates 81 can be attached separately to the rods 3 of the linkage 2. Optionally, the two base plates 81 can be hinged to each other. In addition, the two base plates 81 may have recesses, reinforcements, and/or a roughened surface finish. The two seats 82 may be formed from one or more components and may optionally further include upholstery, armrests, and/or backrests. Furthermore, the stand-up paddle boards 100 according to the embodiment example shown in FIG. 9 are designed as inflatable stand-up paddle boards 100.

FIG. 10 shows a schematic top view and a schematic side view of a connecting device 1 in use as a pedal boat according to the embodiment example in FIG. 9 with further add-on components 8.

The connecting device 1 may further comprise further add-on components 8, such as a table 83, a ladder 84 and a sunshade 89.

FIG. 11 shows a schematic top view and a schematic side view of a connecting device 1 in use as a pedal boat with a propeller 88 according to a further embodiment example of the invention.

Preferably, the connecting device 1 has four rods 3, wherein two of the four rods 3 are arranged in a central region of the stand-up paddle boards 100 and the remaining two of the four rods 3 are respectively arranged in a front and rear region of the stand-up paddle boards 100. The connecting device 1 may further comprise, for example, add-on components 8 such as two base plates 81, two seats 82, a steering rudder 85, and the propeller 88. Said add-on components 8 are detachably attached to the linkage 2, in particular by means of at least one of the connecting components 7 presented in FIGS. 7A, 7B, 8A, 8B, 8C or 8D. Alternatively or additionally, the add-on components 8 are fastened to each other or mutually supported.

FIG. 12 shows a schematic top view and a schematic side view of a connecting device 1 in use as a motorboat according to a further embodiment of the invention.

The connecting device 1 preferably has four rods 3, wherein two of the four rods 3 are arranged in a central region of the stand-up paddle boards 100 and the remaining two of the four rods 3 are arranged in a front and rear region, respectively, of the stand-up paddle boards 100. The connecting device 1 may further comprise, for example, add-on components 8, such as two base plates 81, two seats 82, and an outboard motor 86. Said add-on components 8 are removably attached to the linkage 2, in particular by means of at least one of the connecting components 7 presented in FIGS. 7A, 7B, 8A, 8B, 8C or 8D. Alternatively or additionally, the add-on components 8 are fastened to each other or mutually supported.

In this case, the outboard motor 87 is pivotably attached to the linkage 2 or to one of the two base plates 81, so that the motorboat can be steered by pivoting the outboard motor 87.

FIG. 13 shows a schematic top view and a schematic side view of a connecting device 1 in use as a sailboat according to a further embodiment of the invention.

The connecting device 1 preferably comprises four rods 3, wherein two of the four rods 3 are arranged in a central region of the stand-up paddle boards 100 and the remaining two of the four rods 3 are respectively arranged in a front and rear region of the stand-up paddle boards 100. The connecting device 1 may further comprise, for example, add-on components 8 such as two base plates 81, a steering rudder 85 and a sail 80. Said add-on components 8 are detachably attached to the linkage 2, in particular by means of at least one of the connecting components 7 presented in FIGS. 7A, 7B, 8A, 8B, 8C or 8D. Alternatively or additionally, the add-on components 8 are fastened to each other or mutually supported.

In the preceding detailed description, various features have been summarized in one or more examples to improve the stringency of the presentation. It should be clear, however, that the above description is merely illustrative and in no way limiting. It is intended to cover all alternatives, modifications and equivalents of the various features and embodiments. Many other examples will be immediately and directly obvious to the person skilled in the art based on his technical knowledge in view of the above description.

The embodiment examples have been selected and described in order to best illustrate the principles underlying the invention and its possible applications in practice. This will enable those skilled in the art to optimally modify and utilize the invention and its various embodiments with respect to the intended application. In the claims as well as the description, the terms "comprising" and "comprising" are used as neutral language terms for the corresponding terms "comprising". Furthermore, a use of the terms "one"

and "a" is not intended to exclude in principle a plurality of such described features and components.

LIST OF REFERENCE SIGNS

1 Connecting device
2 linkage
3 rod
4 fastening means
5 axis
6 Tensioning device
7 Connecting component (clip, socket, tilting eccentric lever)
8 Add-on component
40 Retaining clips
41 Insert elements
42 Clamping cone
43 Union nut
44 Bridging beam
45 Engagement tooth
46 Lever
61 Spring button clip
62 Clamping connection
63 Pinch screw connection
64 Spring button
71 Lever element
72 Cone
73 Segments
74 Locking mechanism
80 Sail
81 Base plate
82 Seat
83 table
84 ladder
85 steering rudder
86 Outboard motor
87 Water wheel
88 Propeller
89 Sunshade
100 Floating body
101 Strap

The invention claimed is:

1. Connecting device (1) for connecting at least two floating bodies (100), side by side, comprising: a linkage (2) comprising at least one rod (3); and a plurality of fastening means (4) which are arranged on the at least one rod (3) of the linkage (2) and of which at least some of the plurality of fastening means (4) are provided axially displaceable along an axis (5) of the at least one rod (3) of the linkage (2) adapted to a respective geometry of the at least two floating bodies (100) in such a way that each floating body (100) can be clamped between at least two fastening means (4) on the at least one rod (3) of the linkage (2) in a positionally stable manner, wherein the linkage (2) comprises a plurality of rods (3), wherein two of the plurality of rods (3) extend substantially parallel to each other and are enclosed in sections by a strap (101) of one of the at least two floating bodies (100), wherein the two rods (3) extending substantially parallel to each other can be mounted suitably far apart from each other for tensioning the strap.

2. Connecting Device (1) according to claim 1, wherein retaining clips (40) for positive or non-positive clamping of each floating body (100) are provided on some of the plurality of fastening means (4).

3. Connecting device (1) according to claim 2, wherein the retaining clips (40) are substantially curved and/or inclined and are pivotable about a transverse axis of the at least one rod (3) of the linkage (2).

4. Connecting device (1) according to clam 1, wherein at least two of the plurality of fastening means (4) comprise a bridging beam (44) connecting the at least two of the plurality of fastening means (4) for positive and/or non-positive enclosure of the respective floating body (100).

5. Connecting device (1) according to claim 4, wherein said bridging beam (44) is coupled to said at least two of said plurality of fastening means (4) such that said linkage (2) in cooperation with said at least two of said plurality of fastening means (4) as well as said bridging beam (44) encloses one of said at least two floating bodies (100) in an axis.

6. Connecting device (1) according to claim 1, wherein the plurality of fastening means (4) in a contact area to the at least two floating bodies (100) comprise materials for mechanical protection of the at least two floating bodies (100) against damages are formed curved at least in sections or receive insert elements (41) for mechanical protection of the at least two floating bodies (100) against damages.

7. Connecting device (1) according to claim 1, wherein the at least one rod (3) of the linkage (2) has an external thread at least in sections.

8. Connecting device (1) according to claim 7, wherein some of said plurality of fastening means (4) comprise a clamping cone (42) and a union nut (43), said union nut (43) having an internal conical thread complementary to the external thread of said at least one rod (3) of said linkage (2) such, that the clamping cone (42) can be clamped between itself and the at least one rod (3) of the linkage (2) by means of the union nut (43) in order to axially fix the plurality of fastening means (4) relative to the at least one rod (3) of the linkage (2).

9. Connecting device (1) according to claim 1, wherein the at least one rod (3) of the linkage (2) has toothing at least in sections.

10. Connecting device (1) according to claim 9, wherein some of the plurality of fastening means (4) comprise at least one engagement tooth (45) for axially fixing the fastening means (4) to the at least one rod (3) of the linkage (2), wherein the at least one engagement tooth (45) can be supported on a lever (46) that is pivotally connected to the fastening means (4), and the at least one engagement tooth (45) can be in engagement with the toothing of the at least one rod (3) of the linkage (2).

11. Connecting device (1) according to claim 1, wherein the plurality of rods (3) are each connected to one another via a plug-in connection via a clamp connection (62) or via a screw connection for varying their longitudinal extension adapted to geometries of the at least two floating bodies (100).

12. Connecting device (1) according to claim 1, further comprising at least one connecting element (7) configured to detachably attach an add-on component (8) to the linkage (2) for modular extension of the connecting device (1).

13. Connecting device (1) according to claim 12, wherein the at least one connecting element (7) is designed as a tilting eccentric lever for pressing conical segments (73) apart in through bores and the linkage (2) has through bores with a complementary bore diameter.

14. Connecting device (1) according to claim 12, wherein the at least one connecting element (7) is designed as a clip for pressing the clip onto the linkage (2) in order to couple the add-on component (8) to the linkage (2) in a positive or non-positive manner, or is designed as a socket for plugging on the linkage (2), wherein the linkage (2) has a spring button clip for connecting the linkage (2) to the add-on component (8) in a positive or non-positive manner.

15. A system comprising two floating bodies (100) and a connecting device (1) according to claim 1.

16. Connecting device (1) for connecting at least two floating bodies (100), side by side, comprising: a linkage (2) comprising at least one rod (3); and a plurality of fastening means (4) which are arranged on the at least one rod (3) of the linkage (2) and of which at least some of the plurality of fastening means (4) are provided axially displaceable along an axis (5) of the at least one rod (3) of the linkage (2) adapted to a respective geometry of the at least two floating bodies (100) in such a way that each floating body (100) can be clamped between at least two fastening means (4) on the at least one rod (3) of the linkage (2) in a positionally stable manner, wherein the at least one rod (3) of the linkage (2) comprises a tensioning device (6) for tensioning a strap (101) of one of the at least two floating bodies (100).

* * * * *